United States Patent [19]

Jagelid

[11] 4,285,222

[45] Aug. 25, 1981

[54] MACHINE FOR MANUFACTURE OF SPIRAL TUBING WITH FOLDED SEAM

[75] Inventor: Kjell-Inge Jagelid, Kungsbacka, Sweden

[73] Assignee: Kurt Hedlund, Kungsbacka, Sweden

[21] Appl. No.: 48,189

[22] Filed: Jun. 13, 1979

[30] Foreign Application Priority Data

Dec. 22, 1978 [SE] Sweden ..... 7813290

[51] Int. Cl.[3] ..... B21D 5/12

[52] U.S. Cl. ..... 72/28; 72/49; 72/181

[58] Field of Search ..... 72/49, 50, 181, 28; 113/58

[56] References Cited

U.S. PATENT DOCUMENTS

| | | | |
|---|---|---|---|
| 519,182 | 5/1894 | Gould | 72/50 |
| 2,352,675 | 7/1944 | Yoder | 72/181 |
| 4,070,887 | 1/1978 | Hankin | 72/181 |
| 4,112,722 | 9/1978 | Boucard | 72/181 |

FOREIGN PATENT DOCUMENTS

| | | | |
|---|---|---|---|
| 710556 | 6/1965 | Canada | 72/181 |
| 1168179 | 10/1969 | United Kingdom | 72/50 |

*Primary Examiner*—Lowell A. Larson
*Attorney, Agent, or Firm*—Holman & Stern

[57] ABSTRACT

A machine for the manufacture of helically seamed tubing, including a number of preshaping roller pairs for a strip material and a folding roller pair, arranged to form a folded seam in the strip material while feeding it to a coiling and tube shaping tool, each roller pair being driven by a separate hydraulic motor arranged to drive one of the rollers, the second roller being driven by a cog wheel transmission from the first, the second roller being movable in relation to the first roller in the same roller pair and being spring loaded in the direction towards same the first. The hydraulic motors are connected to each other in series, thus driving the successive individual roller pairs with a successively reduced speed, each roller including at least one surrounding circumferential groove, into which semi-circular ring members having an outwardly extending portion, or a groove, at the outer peripheral surface, are insertable and attachable.

9 Claims, 5 Drawing Figures

MACHINE FOR MANUFACTURE OF SPIRAL TUBING WITH FOLDED SEAM

BRIEF SUMMARY OF THE INVENTION

The present invention relates to a machine for the manufacture of spiral tubing with folded seam, or helically seamed tubing.

Machines for the above purpose are previously known, in which a metal strip material is arranged to pass between a number of roller pairs, which form the necessary depressions in the strip material, whereafter the strip is guided into a shaping tool, arranged to coil the strip material into the shape of a spiral wound tube with a predetermined diameter and also to perform a folding operation, in which the depressions formed by the roller pairs are utilized to produce a folded seam between the adjacent edge portions of the coiled strip material. This technique has for a number of years been utilized for the manufacture of helically seamed tubing, e.g. for ventilation systems.

A major disadvantage with previously known types of machinery for the above purpose is that the roller pairs utilized for preforming the strip material must be changed when the thickness of the strip material is altered, and that the fixed roller pairs do not compensate for existing tolerance variations with regard to thickness of the strip material, which variations in certain cases can be rather large. Said tolerance variations have caused damage to the roller pairs and associated shafts, and it has been a time-consuming task to remove rollers and associated shafts when damaged, since the strip material in the machine causes a wedge acting force, which causes great problems when removing the roller pairs. With regard to previously known types of machines, the succeeding roller pairs are internally connected by means of a chain or cog wheel transmission, whereby the succeeding roller pairs are driven with the same speed. However, it is desirable to arrange the succeeding roller pairs with a gradually reduced speed of rotation, in order to achieve a compensation for the alteration in length caused by the deformation of the strip material during the preshaping operations. Such a compensation in speed has previously been impossible, due to the method utilized for driving the successive roller pairs. The preshaping roller pairs, intended to cause necessary preshaping of the strip material for the final folding operation, as well as in certain cases depressions in the strip material intended to improve the strength of the tube, have previously been manufactured for a certain strip thickness, and for a certain type of preshaping operation, and a change from a strip thickness to another, or a change from one type of preshaping to another, has previously made it necessary to replace the roller pairs. It is obvious, that this has caused long delays during which the machine has been inoperable, during which time the roller pairs have been changed, and that it also has involved considerable costs for manufacture and storage of a large number of different roller pairs. A further disadvantage with regard to previously known types of machinery for the manufacture of helically seamed tubing is, that it has been extremely difficult to accomplish the necessary guiding function of the strip material in relation to the shaping tool, since this guiding function is related to the preshaped portion which is intended to form the folded seam in the shaping tool. To accomplish the orientation of the preshaped portion in relation to the shaping tool has previously been a very time-consuming task. Further disadvantages with previously known types of machinery are, that they include extensive and complicated electrical control devices, that the machines are difficult to move and transport, and that they can only be used if sufficient electrical power is available, and the last mentioned fact has many times caused large difficulties, particularly when a machine is temporarily used in an underdeveloped country. A further disadvantage is, that the complexity of previously known types of machinery has caused a high manufacturing cost and thus a high sales price, and thereby a large machine investment, which only has been regarded as motivated when the machine has been intended for continuous manufacture of helically seamed tubing.

The object of the present invention is to disclose a machine for the manufacture of helically seamed tubing having none of the above mentioned disadvantages relating to previously known types of machinery.

The machine for manufacture of helically seamed tubing according to the present invention can readily be altered for various strip material thicknesses, it will accept large variations in tolerance with regard to the thickness of the strip material, without causing any damage to the machine or parts thereof, it is arranged to successively reduce the speed of rotation for the roller pairs utilized, it includes a simple and improved guiding member for guiding the the preshaped portion of the strip into the shaping tool for the formation of the folded seam, and it makes it possible to utilize a small number of roller pairs for various types of preshaping operations and strip material thicknesses, since the roller pairs can be easily modified for various types of application. A further major advantage is, that the machine can be driven by a combustion engine, i.e. it is eminently suitable for use in underdeveloped countries and locations where electric power is not available sufficiently for previously known types of machinery. Furthermore, the machine is also designed to facilate transport between different locations, and the improved and simple design faciliates manufacture at a cost which is considerably lower than previously known types.

BRIEF DESCRIPTION OF THE SEVERAL VIEWS OF THE DRAWING

An embodiment of a machine for manufacture of spiral tubing with folded seam according to the present invention is more fully described below, reference being made to the accompanying drawings, in which.

DETAILED DESCRIPTION

Figure 1:
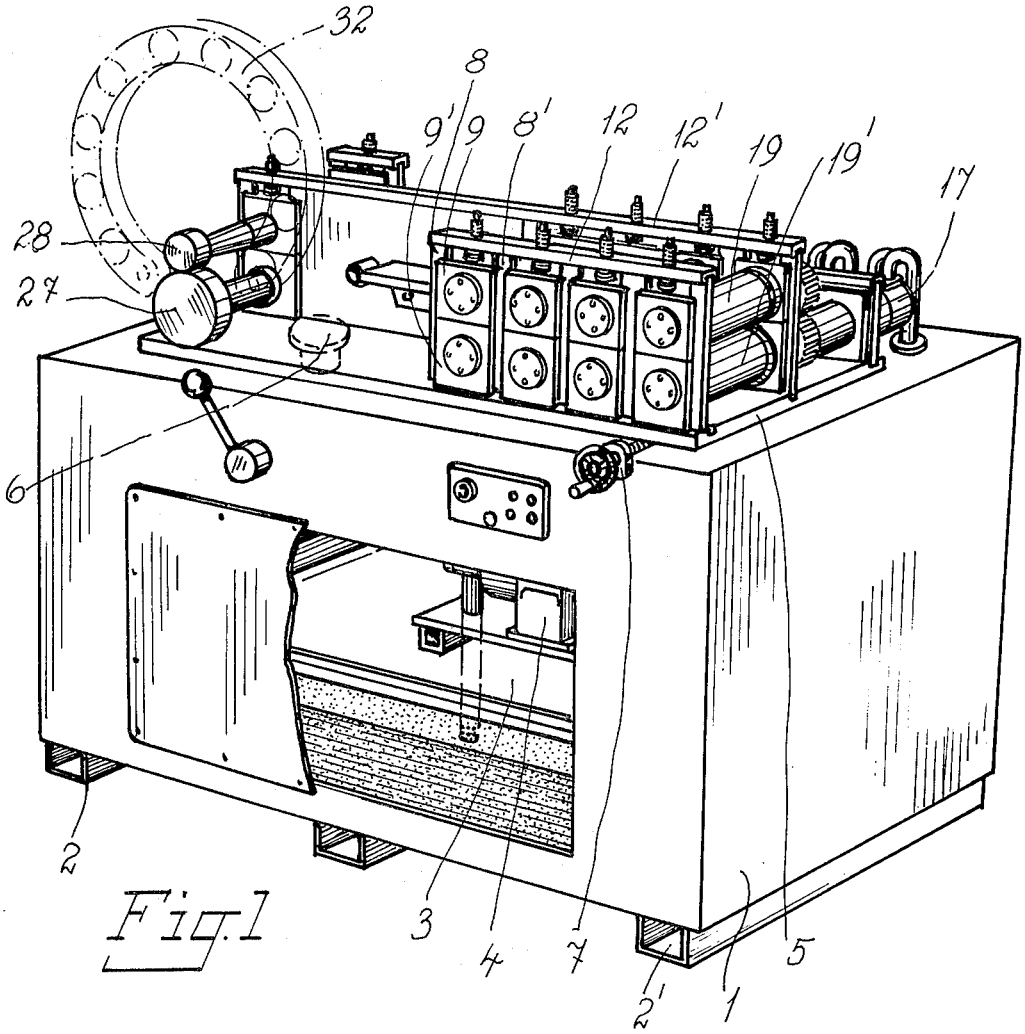
FIG. 1 is a perspective view of an embodiment of a machine according to the present invention.

With reference to FIG. 1 the embodiment shown of a machine according to the present invention comprises a boxshaped structural part 1, advantageously arranged with a number of U-shaped or hollow profiles 2, 2', arranged separated from each other at the lower bottom surface, intended to faciliate insertion of a lifting fork from a fork lift truck or similar, when transporting the machine. The lower part of the structural part 1 comprises an oil tank 3, at the upper surface arranged with a hydraulic pump unit 4 with an associated electric motor. The drive shaft of the electric motor is advantageously arranged extending out through a wall portion of the structural part 1, in order to faciliate connection to an external engine, such as a diesel or gasoline I.C. engine, and thus an auxiliary external drive means (not shown).

At a distance from the upper surface of the boxshaped structural part 1 is a structural plate 5 rotatably connected to a stud 6 at one end portion, supported by an adjustment member 7 at the opposed end portion. When manually operated, the adjustment member faciliates rotation of the structural plate 5 around the stud 6 to desired relative positions in relation to the longitudinal direction of the boxshaped structural part 1.

A number of guiding members 8, 8' are arranged attached to the structural plate 5, extending vertically and in a parallel relationship to each other upwardly from same, and plates 9, 9' are arranged above each other in pairs between same. The plates 9 arranged away from the structural plate 5 are arranged with the upper edge portion in contact with a number of spring washers 10, 10', located surrounding longitudinally extending adjustment members 11, 11'. Said adjustment members 11, 11' are attached by means of a screw thread to a longitudinally extending intermediate part 12, 12', which intermediate parts 12, 12' are arranged at a distance from the adjacent end surfaces of the plates 9. In each plate 9, 9' is a roller bearing or ball bearing 13, 13' arranged, preferably a conical roller bearing, which support a lower drive shaft 14 and an upper supporting shaft 15 respectively.

Figure 2:
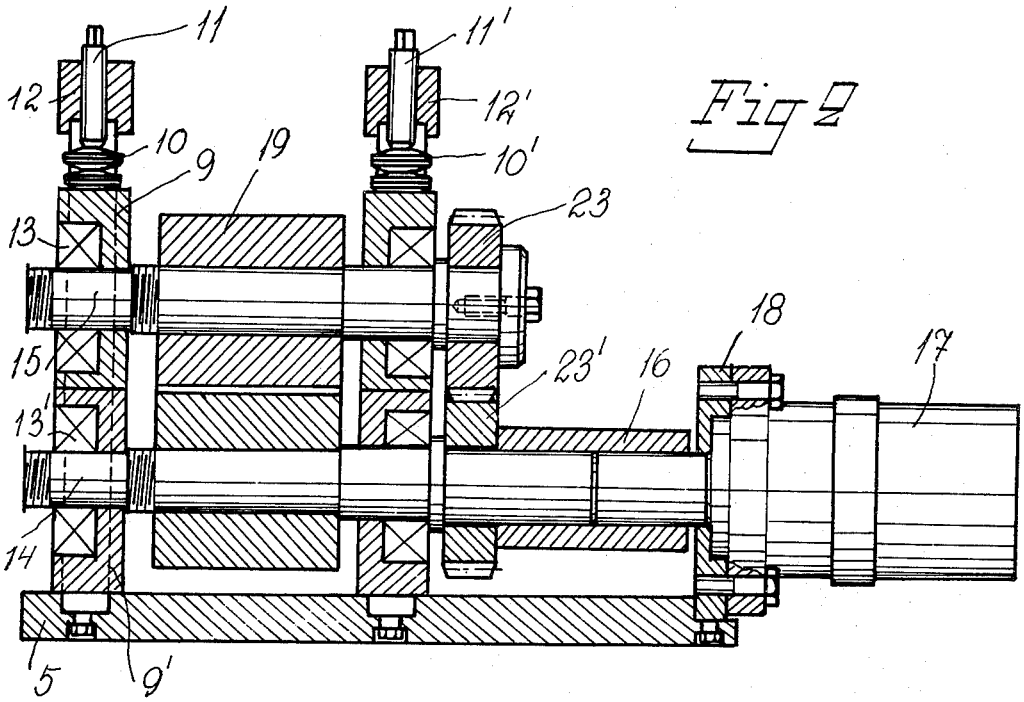
FIG. 2 is a cross-sectional view of a roller pair, included in the machine shown in FIG. 1.

As shown in FIG. 2, the lower drive shaft 14 is considerably longer than the upper supporting shaft 15, and the free end portion of the drive shaft 14 is also surrounded by a tubular joining sleeve 16. Into said joining sleeve 16 extends from the opposed direction the outgoing drive shaft of a hydraulic motor 17, and said shafts 14 and the surrounding tubular joining sleeve 16 are internally locked in a nonrotatable relationship, e.g. by grooves taken up in the tubular sleeve 16 and by corresponding interlockng members attached to the shafts 14. The hydraulic motor 17 is in a previously known way attached by means of bolts or similar fasteners extending between a forward mounting flange and a mounting plate 18, which extends upwardly from the structural plate 5.

The lower drive shaft 14 and the upper supporting shaft 15 are support thereon between the plates 9, 9' rollers 19, 19', which together form a roller pair. Each roller 19, 19' can in a previously known way be formed in one piece with a surrounding shaping member and a surrounding shaping groove respectively.

Figure 5:
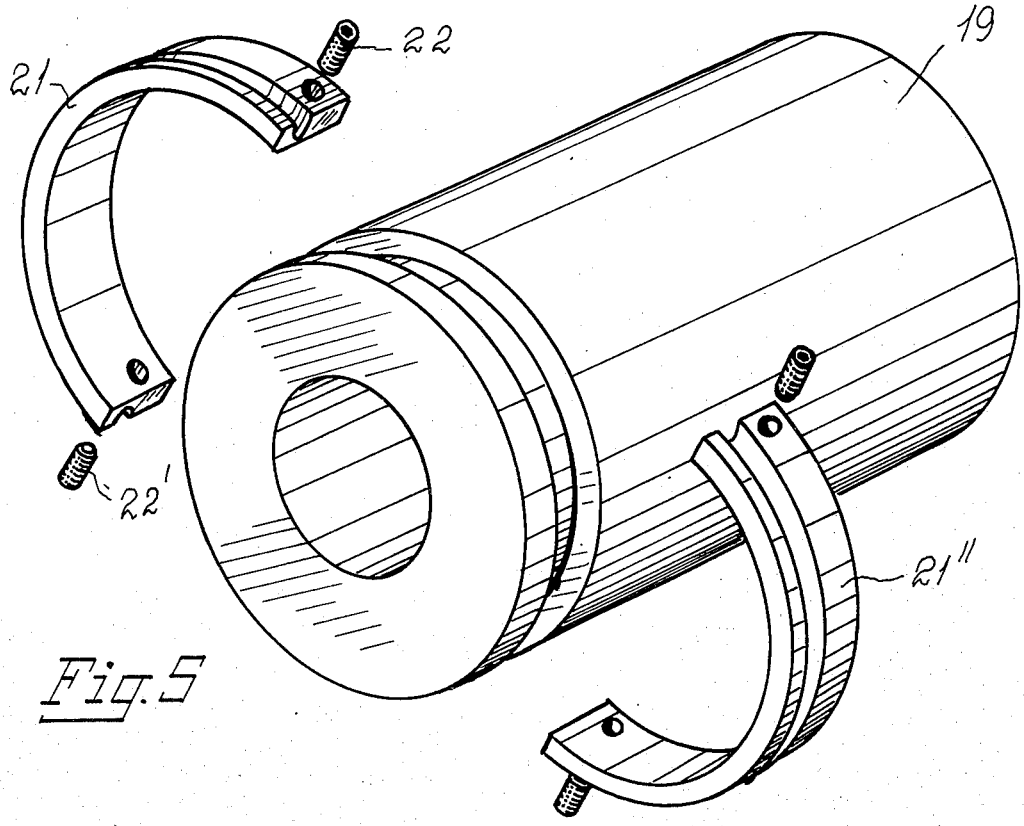
FIG. 5 is an exploded perspective view of a roller, intended to be utilized as a preshaping roller in one of the succeeding roller pairs.

An alternative embodiment is shown in FIG. 5, in which the roller 19 is provided with at least one surrounding groove 20, into which to semi-circular members 21, 21' can be inserted and attached, e.g. by means of two screws 22, 22', as indicated in the figure. The outer peripheral surface of the semi-circular members 21, 21' is arranged with a groove, an outwardly extending shaping profile, or any other desired shape, intended to co-operate with a groove or an outwardly extending part arranged at corresponding members attached to an adjacent and co-operating roller 19'.

It should be emphasized, that the embodiment disclosed with reference to FIG. 5 faciliates utilization of one type only of basic rollers 19, 19' for various types of preshaping operations, both for accomplishing the folded joint as well as for accomplishing desired deformations intended to improve the strength of the tube. For different types of operation, only the semi-circular members 21, 21' need to be replaced, an operation which can be performed in a considerably shorter time than conventional replacement of the roller pairs, and the tool cost (the cost for the rollers 19, 19') is also considerably reduced.

Figure 4:
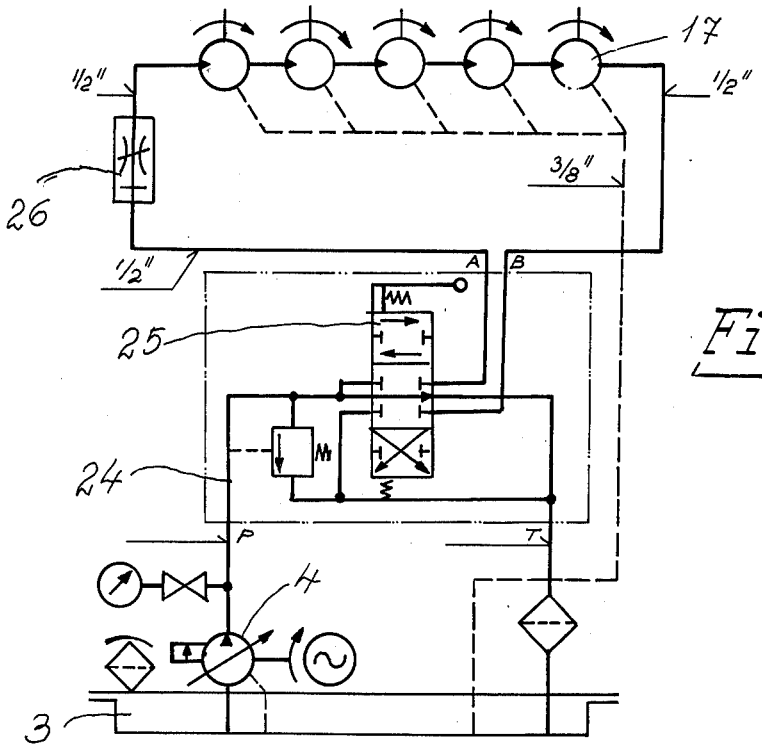
FIG. 4 is a hydraulic circuit diagram for the machine shown in FIG. 1.

The lower drive shaft 14 and the upper supporting shaft 15 are as shown in FIG. 2 provided with two interacting cog wheels 23, 23' immediately behind the plates 9, 9' which are adjacent to the hydraulic motor 17. It should be noted, that each pair of rollers is provided with a separate hydraulic motor 17, as shown in the hydraulics circuit diagram in FIG. 4.

With reference to said circuit diagram, the machine shown in FIG. 1 includes five successive hydraulic motors 17, connected in series in such a way, that the outlet of a first hydraulic motor is connected to the inlet of a second and successive hydraulic motor 17. Due to the perssure drop caused in each hydraulic motor, the speed is slightly reduced for each successive motor 17, a function which is most desirable. From the oil tank 3 and the pump unit 4, the oil is transported through a pipe 24 to a fourway-valve 25, arranged to faciliate interruption of the oil flow to the hydraulic motors 17, as well as an oil flow to drive same into alternative directions of rotation, the reversed direction of rotation in certain cases being desirable to faciliate a return movement of a material strip in the machine, or, when setting the controls of the machine. In the circuit joining the hydraulic motors 17 with the fourway-valve 25 is a flow adjustment valve 26 arranged to allow the operator to gradually increase or decrease the rotation speed of the rollers.

At a distance from the four adjacent pairs of rollers 19, 19' are two folding rollers 27, 28 arranged in a previously known way, the lower roller 27 being driven in a corresponding way to the previously discussed preshaping roller pairs 19, 19' by means of a separate hydraulic motor 17, the upper roller 28 being arranged correspondingly to the upper preshaping rollers 19. The upper folding roller 28 is movable in relation to the lower roller 27, and is supported adjustably with respect thereto in the same manner as rollers 19 with a number of spring washers, arranged as previously described.

Figure 3:
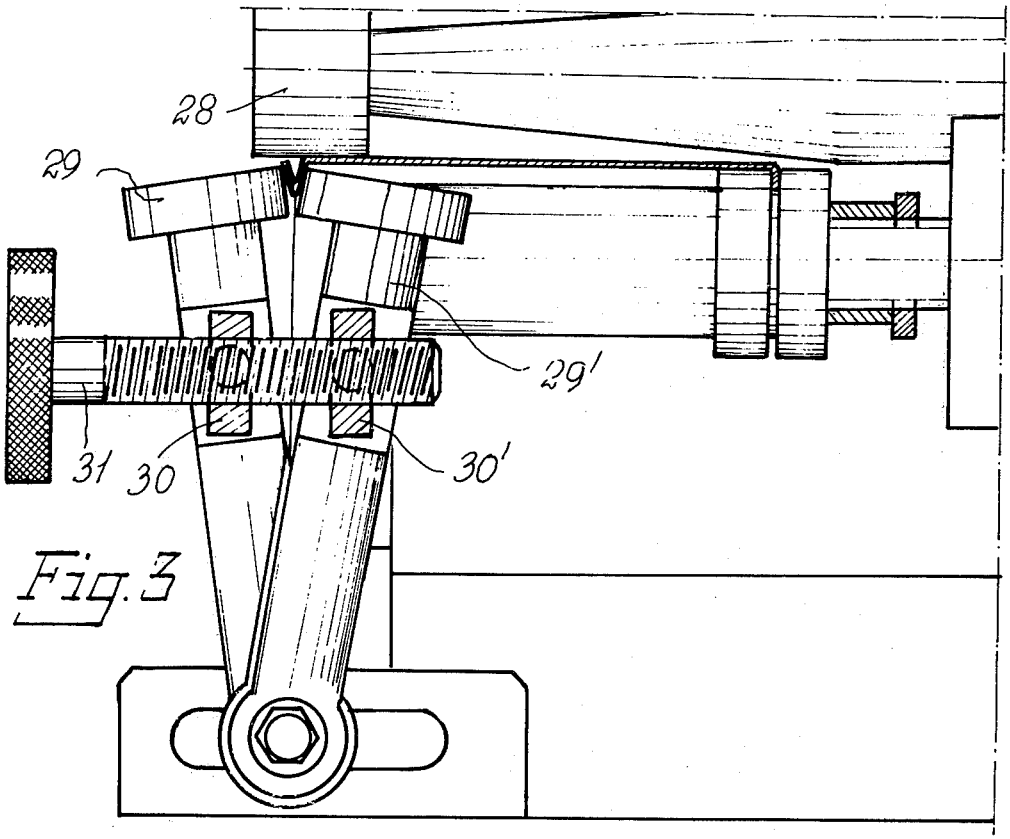
FIG. 3 is a view, partly in cross-section, of a guiding device for the preshaped strip material, located adjacent to the roller pair forming the folded seam.

In order to obtain necessary guidance of the preshaped material strip in relation to the folding pair of rollers 27, 28, the machine according to the present invention is advantageously arranged with a guiding device as shown in FIG. 3. Said guiding device has two guiding members 29, 29', pivotably attached at one end portion, and two nut members 30, 30' movably linked to the guiding members 29, 29', a screw member 31 having an external screw thread being arranged extending through the nut members 30, 30'. The internal screw thread of said nut members 30, 30' and/or the external screw thread of the screw member 31 is arranged in such a way, that rotation of the screw member 31 in a first direction of rotation causes the guiding end portions of the guiding members 29, 29' to move simultaneously in a direction away from each other, whereas rotation in an opposed direction causes the guiding end portions to simultaneously move in a direction towards each other. Obviously, this device facilitates fast, efficient and simple adjustment of the guiding device in relation to the preshaped portion of the strip material, whereby said preshaped portion is exactly orientated in relation to the folding rollers 27, 28.

When using the machine described above, and illustrated in the accompanying drawings, rollers 19, 19' suitable for desired operation are first attached. With reference to FIG. 2, it is shown that the shafts 14, 15 are arranged with successively reduced diameter from one end portion, which faciliates a sliding movement in axial direction for the shafts 14, 15 from the position shown in the figure, whereafter the rollers 19, 19' choosen can be inserted between the plates 9, 9'. Thereafter, the shafts 14, 15 are slid back to the position shown. Since the plates 9 carrying the upper shafts 15 are spring loaded, rollers having a certain diameter can be used for a large range of strip material thicknesses. The spring force obtained from the spring washers 10, 10' is adjusted by means of the adjustment members 11, 11'. When the thickness of the strip material varies, said spring washers 10, 10' take up the existing differences, without causing any damage to the roller pairs 19, 19', associated shafts 14, 15, or shaft mountings. Adjacent to the end portion of the structural plate 5 following the folding rollers 27, 28, a tool 32 is attached to the structural base 1, said tool 32 only being indicated with broken lines in FIG. 1. During the folding operation, the strip material is guided into the tool, thereby being formed to the intended tube diameter, the inside diameter of the tool deciding the outside diameter of the sprial tube. The tool consists of fixed preshaped parts, arranged in a previously known way.

By means of the adjustment member 7, the angle in which the strip material is fed into the tool 32 can be varied, by adjusting the structural plate 5 to desired angle in relation to the tool 32.

The hydraulic drive for the roller pairs utilized has, as previously mentioned, the advantage of a successively reduced feeding speed. Since the drive shaft for the electric motor is arranged extending outside the base structural part 1, the machine can also be used without access to electrical power, in which case the protruding shaft is joined to a combustion engine. The method in which the rollers are arranged spring loaded eliminates the risk of damage to the rollers and associated shafts caused by tolerance variations in the thickness of the strip material, and faciliates use of roller pairs having a certain diameter for a range of material thickness, without any need for replacement of the rollers. The possibility to arrange the rollers 19, 19' with detachable semi-circular members 21, 21', as indicated in FIG. 5, also reduces the time necessary for machine setting operations, and makes it possible to utilize a certain pair of rollers for a large number of different operations. The method in which guidance of the strip material is achieved, as shown in FIG. 3, also faciliates simple and fast machine setting operations.

The described and shown embodiment of a machine according to the present invention is only intended to serve as an example of a machine within the scope of the present invention, in view of the large number of modifications which can be performed, maintaining the important and characteristic features of the invention.

The present invention is thus in no way restricted to the shown and described embodiment, since the machine obviously can be modified with regard to type of springs utilized, number of roller pairs utilized for the preshaping operations, and also in many other respects.

I claim:

1. In a machine for the manufacture of helically seamed tubing, including a plurality of successive roller pairs adapted to preshape a strip material, and a helical coiling tube shaping tool adapted to join two edge portions of the strip material by means of said folded seam the improvement comprising each pair of rollers is provided with a separate hydraulic drive motor operatively connected to a first roller, the second roller being driven by the first roller via a transmission means, fluid pressure means for driving said motors, said motors being connected in series in a hydraulic circuit from said fluid pressure means whereby the outlet of each motor is connected to the inlet of the motor for the next successive pair of rollers.

2. A machine according to claim 1, wherein said second rollers are resiliently urged towards said first rollers by spring means and are adjustable in relation to said first rollers.

3. A machine according to claim 2, wherein the force of said spring means is adjustable.

4. A machine according to any one of claims 1–3, wherein said rollers and drive motors are mounted on a boxshaped structural part and further comprising a hydraulic pump unit driven by an electrical motor mounted within said boxshaped structural part, an oil tank within said boxshaped structural part, said boxshaped structural part being provided with U-shaped legs at the lower bottom portion thereof arranged to facilitate insertion of a lift fork from a fork lift truck.

5. A machine according to claim 4, wherein the drive shaft of the electrical motor has an extension extending through said structural part to facilitate connection to an I.C. engine outside the structural part.

6. A machine according to any one of claims 1–3, and further comprising stepped shafts for supporting the preshaping rollers, means for rotatably supporting said shafts, said stepped shafts and supporting means therefore cooperating to facilitate removal of said rollers by an axially directed sliding movement of said shafts in relation to said rollers and said shaft support means.

7. A machine according to any of claims 1–3, wherein said preshaping rollers have at least one circumferential groove semi-circular forming members engageable within said grooves, means for removably attaching said forming members in said grooves to form a cylindrical forming member, the outer peripheral surface of said semi-circular forming members being provided with a groove or an outwardly extending part adapted to interact with the adjacent roller of each said pair of rollers to accomplish preshaping of said strip material passing between the rollers.

8. A machine according to any of claims 1–3, wherein said fluid circuit is provided with a valve member adapted to facilitate a reversable oil flow to the hydraulic motors and interruption of the flow, and an oil flow restricting member arranged to facilitate a manually variable oil flow to the hydraulic motors.

9. A machine according to claim 3, wherein a guiding means is provided for guiding said preshaped strip material to the final pair of rollers for folding a seam comprising two guiding members each having a rod-like stem with a guiding head at one end and being pivotably mounted on an adjustable common axis at the other end, internally threaded members pivotably mounted on each stem between said ends, an adjustment screw threadably engaging both said internally threaded members, said threads being adapted so that rotation of said adjustment screw in opposite directions will simultaneously move said guiding heads towards or away from each other, said guiding heads engaging opposite sides of said folded seam.

* * * * *